US005235242A

United States Patent [19]

Jeong

[11] Patent Number: 5,235,242

[45] Date of Patent: Aug. 10, 1993

[54] CATHODE SUPPORT STRUCTURE OF AN ELECTRON GUN FOR A CATHODE RAY TUBE

[75] Inventor: Jong-Gyu Jeong, Suwon, Rep. of Korea

[73] Assignee: Samsung Electron Device Co., Ltd., Rep. of Korea

[21] Appl. No.: 840,718

[22] Filed: Feb. 11, 1992

[30] Foreign Application Priority Data

Feb. 12, 1991 [KR] Rep. of Korea ..... 91-2132

[51] Int. Cl.[5] ..... H01J 29/02; H01J 29/04

[52] U.S. Cl. ..... 313/446; 313/417; 313/451; 313/456

[58] Field of Search ..... 313/417, 446, 451, 456, 313/457

[56] References Cited

U.S. PATENT DOCUMENTS 2,745,979 5/1956 Aupoix et al. ..... 313/456

3,603,829 9/1971 Tsuneta et al. ..... 313/417

3,974,416 8/1976 van der Groot et al. ..... 313/451 X

*Primary Examiner*—Sandra L. O'Shea

*Attorney, Agent, or Firm*—Majestic, Parsons, Siebert & Hsue

[57] ABSTRACT

The present invention relates to a cathode support structure of an electron gun for a cathode ray tube for improving the electron beam emission characteristics by way of ensuring the support operation of the cathode, whereby upgrading the white balance holding characteristics and preventing the degradation of carbonate. A cathode support structure of an electron gun for a cathode ray tube which is designed to support the cathode support member 2, 2' or 2'' using the support strip 3, 3' or 3'' between the bead glasses 1 where the support strip 3, 3' or 3'' has semicircular curved surface 3*a*, 3*a'* or 3*a''* which encompassing the cylindrical cathode support meber 2, 2' or 2'' for secure fixation and having a pair of integral reinforcement strips 4, 4' or 4''.

4 Claims, 2 Drawing Sheets

CATHODE SUPPORT STRUCTURE OF AN ELECTRON GUN FOR A CATHODE RAY TUBE

BACKGROUND OF THE INVENTION

1. Field of the Invention

The present invention relates to a cathode support structure of an electron gun for a cathode ray tube, and more particularly to a cathode support structure of the electron gun for the cathode ray tube for improving the electron emission characteristics by upgrading the cathode support structure.

2. Description of the prior arts

In the conventional cathode support structure for supporting the cathode which emits the electron beams in the cathode ray tube, as shown in FIGS. 3 and 4, the cathode support member 21 for green electron gun (not shown) is connected to each of the bead glass 20 by way of a support strip 22 which has a curved form at the center thereof, the cathode support member 23 for blue electron gun (not shown) connected by way of another support strip 24 while the cathode support member 25 for red electron gun (not shown) is connected to each of the bead glass 20 by way of a third support strip 26.

The respective cathode support member 21, 23 or 25 and the respective curve-shaped support strip 22, 24 or 26 are welded for fixation at the curved area for which the respective cylindrical cathode support member 21, 23 or 25 and the respective support strip 22, 24 or 26 are marked at predetermined points of the respective curved areas for exact welding.

The above-cited conventional cathode support structure has, however, one drawback of lowered emission characteristics of electron beams and declined white balance holding characteristics due to the inferior welding strength distribution between the above cathode support member 21, 23 or 25 and the support strip 22, 24 or 26.

Another drawback of the conventional cathode support structure, in case of there being defective supporting operation gets influenced by the impact of carbonate which is the electron radiation material being stuck to the upper end of the cathode and deteriorates the characteristics of the electron gun as the thermal expansion goes ununiformed.

SUMMARY OF THE INVENTION

It is an object of the invention, in consideration of the above drawbacks, to provide a cathode support structure of an electron gun for a cathode ray tube wherein the electron gun is securely supported by removing the ununiformity of the support strength caused by the poor welding.

It is another object of the present invention to provide a cathode support structure of an electron gun for a cathode ray tube wherein the white balance holding characteristics and emission characteristics are improved.

In order to accomplish the above objects, a support strip of a semicircular curved portion formed in the middle has been provided to support the cylindrical cathode support member designed to accept the cathode in between the two bead glasses, and on the middle of the said support strip a pair of press-worked reinforcement strips are formed to shield, fix and support the above cylindrical cathode support member, maintaining certain space. By the above construction, the supportive operation of the cathode support member can be improved.

For fuller understanding of the nature and objects of the invention, reference should be made to the following detailed description taken in conjunction with the accompanying drawings in which:

DESCRIPTION OF THE PREFERRED EMBODIMENTS

Figure 1:
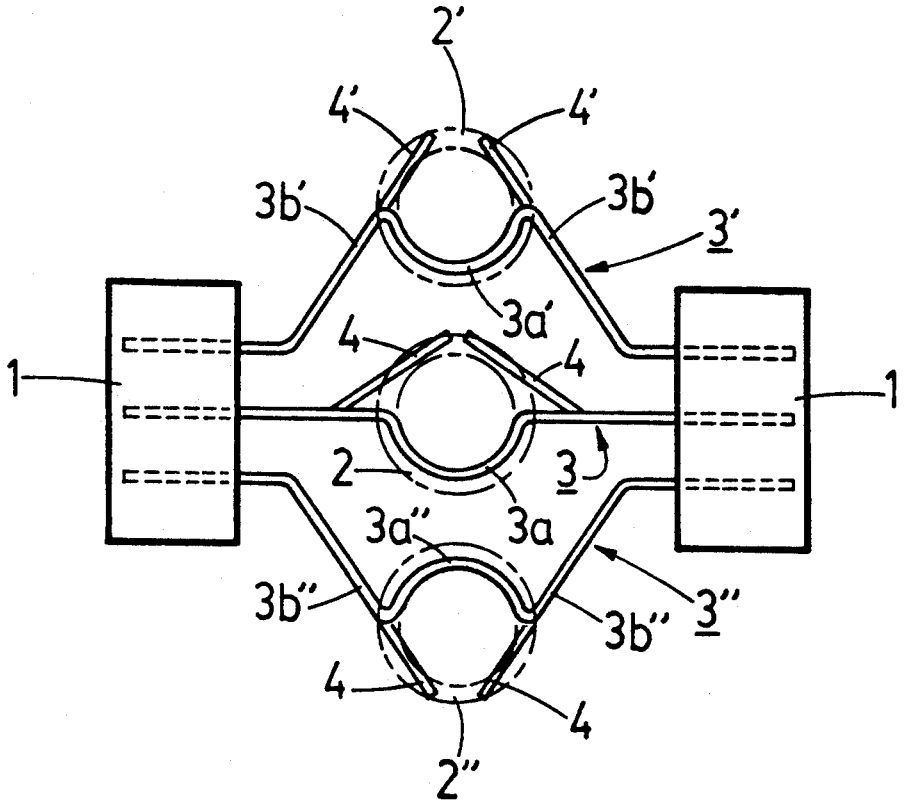
FIG. 1 is a schematic plane view of a cathode support structure of an electron gun according to the the present invention.
Figure 2:
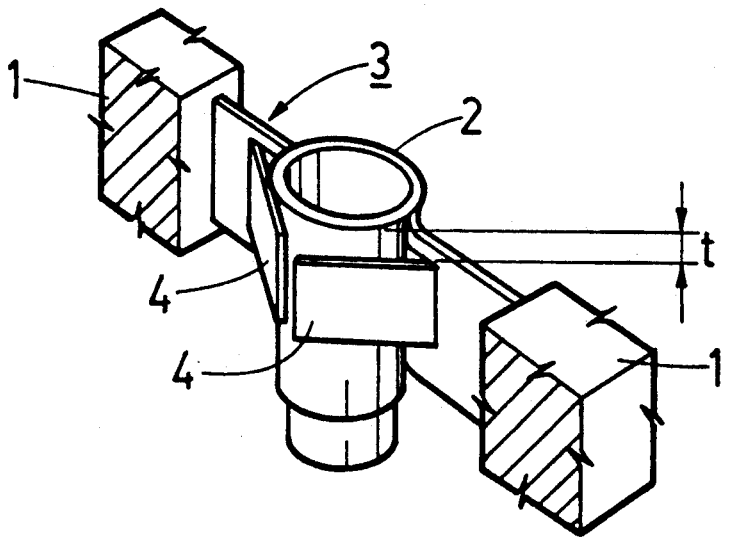
FIG. 2 is a perspective view showing only the cathode support structure located in the middle of FIG. 1.
Figure 3:
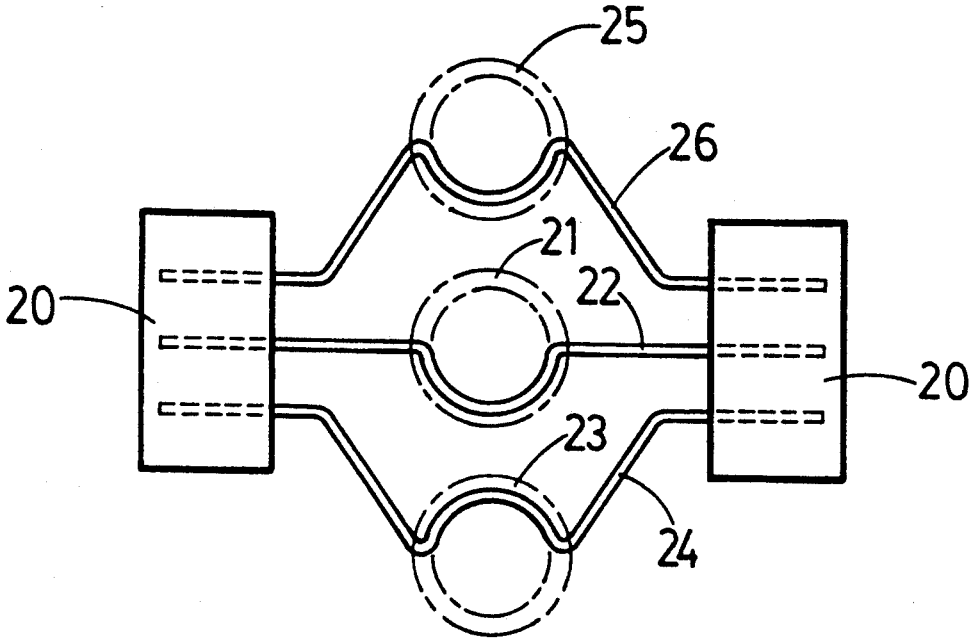
FIG. 3. PRIOR ART
FIG. 3 is a schematic plane view of the conventional cathode support structure.
Figure 4:
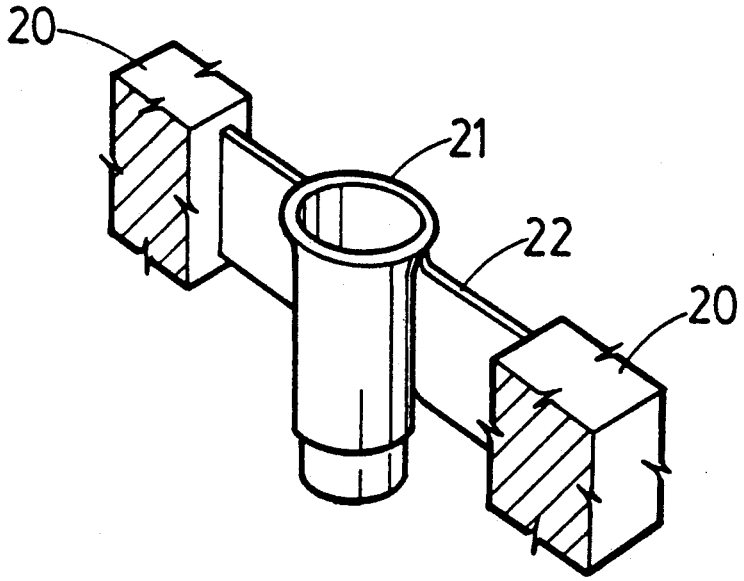
FIG. 4. PRIOR ART
FIG. 4 is a perspective view showing only the cathode support structure located in the middle of FIG. 3.

The structures of red, blue and green electron guns and their support structures are basically the same that, for the convenience of explanation, an example of cathode support structure of green electron gun in the middle is singled out for explanation in this invention. For reference only for this invention, the reference numerals for the cathode support structures of red and blue electron guns, in the same construction, are encoded as (′) and (″).

Referring to FIG. 1, a cylindrical cathode support member 2 is designed to receive and fix the cathode (not shown) situated in between the two bead glasses 1. A support strip 3 having a semicircular shape in the middle where upon circular surface 3*a* is formed. On the circular surface 3*a* which is the center section of this support strip 3 lies a pair of reinforcement strips 4 that face each other encompassing the opposite side of the cylindrical cathode support member 2. This set of reinforcement strips 4 are made of press-worked, integrally with the circular surface 3*a* of the support strip 3 while maintaining a sloped angle therebetween.

Meanwhile, as shown in FIG. 1, the arranged position of an in-line style electron gun (not shown) is so aligned on a straight line that a cathode support member 2′ for a red electron gun positioned on the upper side and a cathode support member 2″ for a blue electron gun positioned on the lower side have a little different support structure from that for the green electron gun.

In other words, support strip 3′ or 3″ that fixes and connects the above-mentioned cathode support members 2′ or 2″ to the bead glasses 1 is generally W-shaped arranged position-wise, namely a semicircular curved surface 3*a′* or 3″ is formed to encompass the cathode support member 2′ or 2″ in the middle and slanted portion 3*b′* or 3*b″* is made to form between the two support cylinders 1, respectively.

The angle between the press-worked reinforcement strip 4′ or 4″ being formed to extend from the said semicircular curved surface 3*a′* or 3*a″* is made to have bigger angle than that of the reinforcement strip 4 for the centered green electron gun. Therefore, the reinforcement strip 4′ or 4″ is so extended to position on the same straight line as the slanted portion 3*b′* or 3*b″* that cathode support member 2′ or 2″ is to have strong support.

Herewith, the reinforcement strip 3, 3′ or 3″ is welded for fixation to the outer round surface of the cathode support member 2, 2′ or 2″ respectively, maintaining a given distance t from the upper end thereof.

The distance t in the above was determined in consideration of the welding strength and related support strength, so the distance t is maintained preferably in the range between 0.5 mm and 1.5 mm.

In the present invention in accordance with the above structure, cylindrical cathode support member 2, 2' or 2'' is so respectively welded at 5 points to the curved surface 3*a*, 3*a'* or 3*a''* of the support strip 3, 3' or 3'' by a pair of reinforcement strips 4, 4' or 4'' for strong fixation that support strength is to be augmented. Accordingly, the cathode(not shown) is strongly supported, and is protected effectively from the outside impact, whereby improving the emission characteristics.

As explained in the above embodiment of the present invention, the cylindrical cathode support member 2, 2' or 2'' is supported firmly by the support strip 3, 3' or 3'' and a pair of reinforcement strips 4, 4' or 4'' to give the secure support onto the cathode, which improves the electron beam emission characteristics of the electron gun, and at the same time prevents the degradation of carbonate, the electron emissive material stuck to the upper portion of electron gun, and finally upgrade the white balance holding characteristics that affects the definition of a color television.

What is claimed is:

1. A cathode support structure of an electron gun for a cathode ray tube designed to support a cylindrical cathode support member, using support strip between bead glasses comprising;

a semicircular curved surface formed with support strip for encompassing said cylindrical cathode support member; and a pair of reinforcement strips made integrally out of said curved surface.

2. A cathode support structure in accordance with claim 1, wherein said reinforcement strips are welded to said cylindrical cathode support member where the distance between the upper end of said cathode support member and the top end of said reinforcement strip is maintained in the range between 0.5 and 1.5 mm.

3. A cathode support structure in accordance with claim 1, wherein said support strip has a slanted portion and said reinforcement strips are extended therefrom on one same straight line.

4. A cathode support structure in accordance with claim 1, wherein said support strip is formed to have a straight shape and said reinforcement strips are extended to maintain a sloped angle therebetween.

* * * * *